US007614270B2

(12) United States Patent
Luckey, Jr. et al.

(10) Patent No.: US 7,614,270 B2
(45) Date of Patent: Nov. 10, 2009

(54) METHOD AND APPARATUS FOR SUPERPLASTIC FORMING

(75) Inventors: S. George Luckey, Jr., Dearborn, MI (US); Peter A. Friedman, Ann Arbor, MI (US); Yingbing Luo, Ann Arbor, MI (US); Warren Copple, Trenton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 12/031,451

(22) Filed: Feb. 14, 2008

(65) Prior Publication Data

US 2009/0205394 A1 Aug. 20, 2009

(51) Int. Cl.
*B21D 26/02* (2006.01)
*B21D 22/22* (2006.01)

(52) U.S. Cl. ..... 72/57; 72/60; 72/342.7; 29/421.1

(58) Field of Classification Search ..... 72/56, 72/57, 60, 342.7; 29/421.1
See application file for complete search history.

(56) References Cited

U.S. PATENT DOCUMENTS 3,208,255 A * 9/1965 Burk ..... 72/57
3,596,485 A * 8/1971 Burk ..... 72/57
4,314,468 A * 2/1982 Baril et al. ..... 72/57
4,689,979 A * 9/1987 Otsuka et al. ..... 72/57
6,481,256 B1 * 11/2002 Beyer et al. ..... 72/57
6,513,359 B1 * 2/2003 Binder et al. ..... 72/57
6,631,630 B1 * 10/2003 Pourboghrat et al. ..... 72/60
6,708,543 B2 * 3/2004 Yoshioka et al. ..... 72/57
6,843,089 B2 * 1/2005 Krajewski et al. ..... 72/60
6,910,358 B2 * 6/2005 Schroth ..... 72/57
7,204,119 B2 * 4/2007 Kruger et al. ..... 72/342.7
7,363,790 B2 * 4/2008 Kruger et al. ..... 72/57

* cited by examiner

*Primary Examiner*—David B Jones
(74) *Attorney, Agent, or Firm*—Tung & Associates; Raymond L. Coppiellie

(57) ABSTRACT

The present invention provides a method and apparatus for forming a ductile sheet or work piece into a part or component. The method includes using a forming apparatus wherein the workpiece is placed between and upper die and a blank holder and then lowered onto a punch such that continued lowering of the upper die draws the workpiece around the punch. Once the draw process is complete, gas pressure acts on one side of the workpiece to press the workpiece against a forming surface of the punch to complete the forming process.

19 Claims, 7 Drawing Sheets

XI
X

METHOD AND APPARATUS FOR SUPERPLASTIC FORMING

CROSS-REFERENCE TO RELATED APPLICATIONS

Not Applicable

BACKGROUND OF THE INVENTION

1. Field of the Invention

The present invention relates generally to material forming and more specifically to an apparatus and method for forming a workpiece at an elevated temperature.

2. Description of Related Art

Various methods are known for forming a metal sheet into a part or component. One method involves a draw process wherein a punch pulls a portion of the metal sheet into a die set and presses the metal sheet into a die cavity of the die set to form the part. During the process, the metal sheet typically undergoes a reduction or change in the cross-sectional area or wall thickness of the sheet. Such processes are typically limited by the material's ability to be strained past its rupture point. Thus, depending upon the complexity of the part, the forming stresses on the metal sheet during the forming process may result in metal failure or fatigue and correspondingly an unusable or scrap part.

Superplastic forming is a process that takes advantage of a material's superplasticity or ability to be strained past its rupture point under certain elevated temperature conditions. Superplasticity in metals is defined by very high tensile elongation and is the ability of certain materials to undergo extreme elongation at proper temperature and strain rate. Superplastic forming is a process used to produce parts that are difficult to form using conventional fabrication techniques.

During the superplastic forming process, the metal sheet, or as often referred to, the blank, is heated to a point of superplasticity and placed in a heated die set. The heated blank is clamped in the heated die set and predefined gas pressure is applied to one side of the sheet. The pressure forces the sheet into a die cavity of the female die while maintaining a target strain rate for deforming the sheet throughout the forming cycle. The superplasticity of the material enables forming of complex components that normally cannot be formed by conventional room temperature metal forming processes. Use of a superplastic forming process enables forming a workpiece with a deep cavity or one formed over very small radii. Superplastic forming does have a disadvantage in that it normally requires relatively long forming cycle times. Specifically, a conventional superplastic forming process used to manufacture a complex part can require a forming cycle time as high as 30 minutes.

Superplastic forming offers several advantages over conventional stamping techniques including increased forming strains, zero springback and very low tooling costs. However, superplastic forming often requires slow forming rates, which can make the process economically unfeasible for many applications. One process for forming a part from a metal sheet using superplastic forming includes using a preform punch to impart an initial generic shape to the metal sheet prior to applying gas pressure to complete the forming process by forcing the metal sheet into the die cavity of the female die to form the part.

SUMMARY OF THE INVENTION

The present invention is a superplastic forming method and apparatus for forming a metal sheet into a part or component. The method includes a forming apparatus having an upper die member, a punch and a blank holder. Initially, the metal sheet or workpiece is placed between the upper die member and blank holder and is then lowered onto the punch such that the workpiece is mechanically drawn around the punch, with the blank holder controlling the rate and amount of material drawn over the punch. The blank-holder effect is accomplished by a cushion system. Once the draw process is complete, gas pressure acting on one side of the workpiece presses the workpiece against a forming surface of the punch and completes the forming process. Once the workpiece is fully formed, the workpiece is lifted off the punch and removed from the forming apparatus.

The present invention further includes an apparatus for forming the workpiece including a die member having a cavity therein, the cavity having a non-forming surface. The apparatus further includes a punch sized to extend into the cavity during the forming process. The punch includes a forming surface configured to form the workpiece in its final form or shape. The apparatus further includes a blank holder that operates to sandwich the workpiece between the upper die and the blank holder to both control the amount of material drawn over the punch and create a pressure seal between the workpiece and the die member to seal the cavity. Accordingly, gas pressure supplied to the cavity forces the workpiece against the forming surface of the punch to ultimately form the workpiece.

DETAILED DESCRIPTION OF THE PREFERRED EMBODIMENTS

Figure 1:
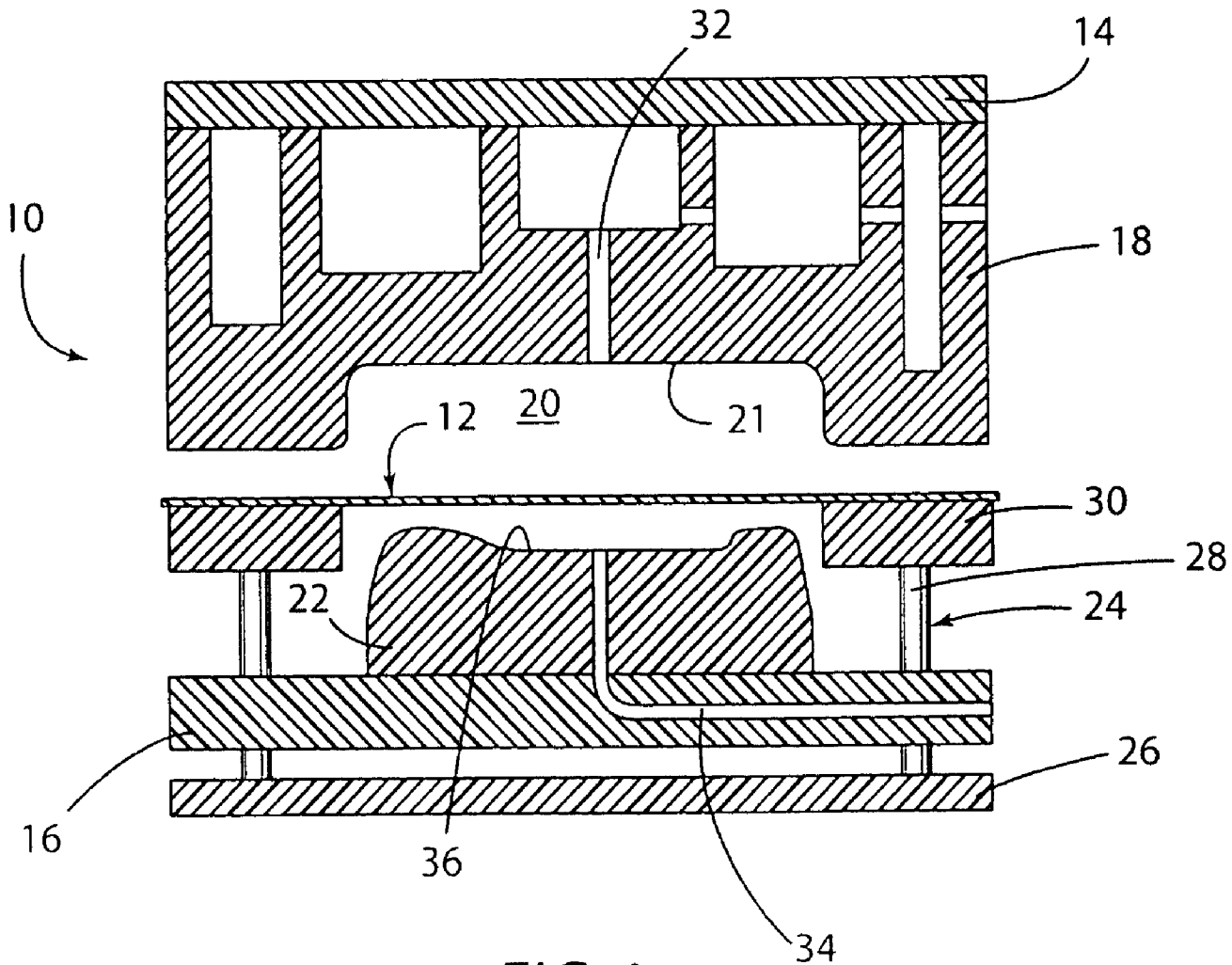
FIG. 1 is a cross-sectional view of a forming apparatus used for forming a workpiece according to the present invention.

Referring now to the drawings, FIG. 1 illustrates one embodiment of the present invention shown as a forming tool or apparatus 10 for forming a workpiece or part 12, typically a metal sheet often referred to as a blank. The forming apparatus 10 includes an upper die shoe or platen 14 and a lower die shoe or platen 16. An upper die 18 having a cavity 20 is secured to the upper die shoe 14. The cavity 20 includes a non-forming surface 21. The non-forming surface 21 is not used to form the workpiece 12; specifically, while the non-forming surface 21 forms a portion of the cavity 20, the workpiece 12 does not contact the non-forming surface 21 during the forming process. A punch 22 is secured to the lower die shoe 16. The forming apparatus 10 also includes a cushion system 24 including a cushion plate 26 and cushion pins 28. The cushion pins 28 are attached on one end thereof to the cushion plate 26 and a blank holder 30 is attached to the cushion pins 28 on the ends opposite the cushion plate 26.

The upper die 18 includes at least one passage 32. A pressure source (not shown) supplies pressure through the passage 32 to the cavity 20. Typically, the pressure source is a supply of pressurized gas suitable for use in a superplastic forming process. Various gases are used depending upon the composition or material of the workpiece 12 being formed. The lower die shoe 16 includes at least one passage 34 that extends through the lower die shoe 16 and punch 22 terminating at a forming surface 36 of the punch 22. As disclosed herein, the forming surface 36 of the punch 22 is the forming surface against which the workpiece 12 is pressed to form the final shape. By pressing the workpiece 12 over the forming surface 36 of the punch 22, the outer or class A surface does not touch the upper die 18 of the forming apparatus 10 during the forming process. Thus, the forming apparatus 10 of the present invention is suitable for forming the workpiece 12 into a part requiring a high quality, class A surface. Class A surfaces are those aesthetic surfaces, which are visible to us (interior/exterior), having an optimal aesthetic shape and high surface quality. As will be understood by those skilled in the art, the forming apparatus 10 can also be used to form a variety of parts requiring a high quality, class A surface by using gas-pressure superplastic forming to press a workpiece 12 over the forming surface 36 of the punch 22.

Figure 2:
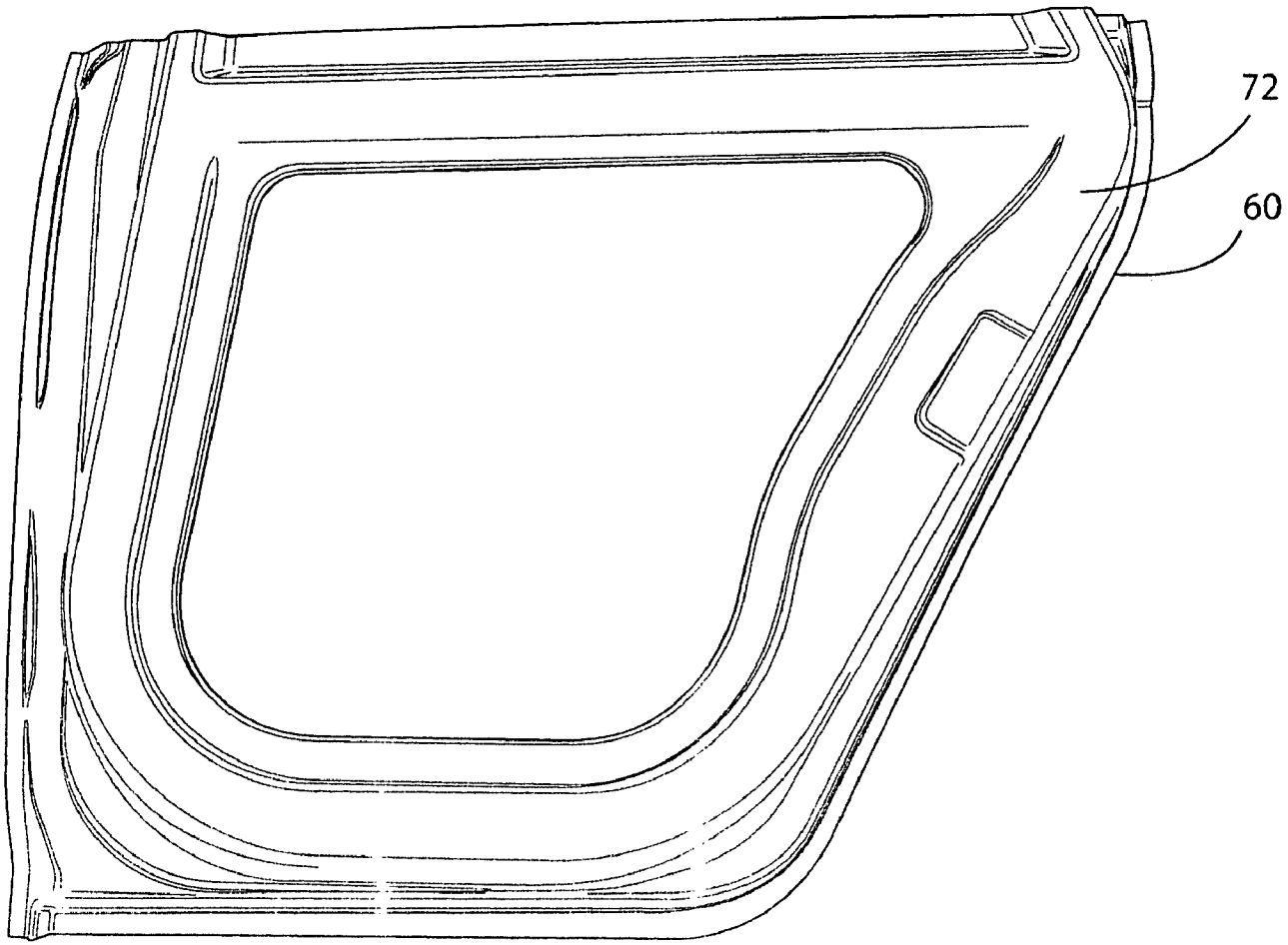
FIG. 2 is a front view of an inner door panel formed using the method and apparatus of the present invention.
Figure 3:
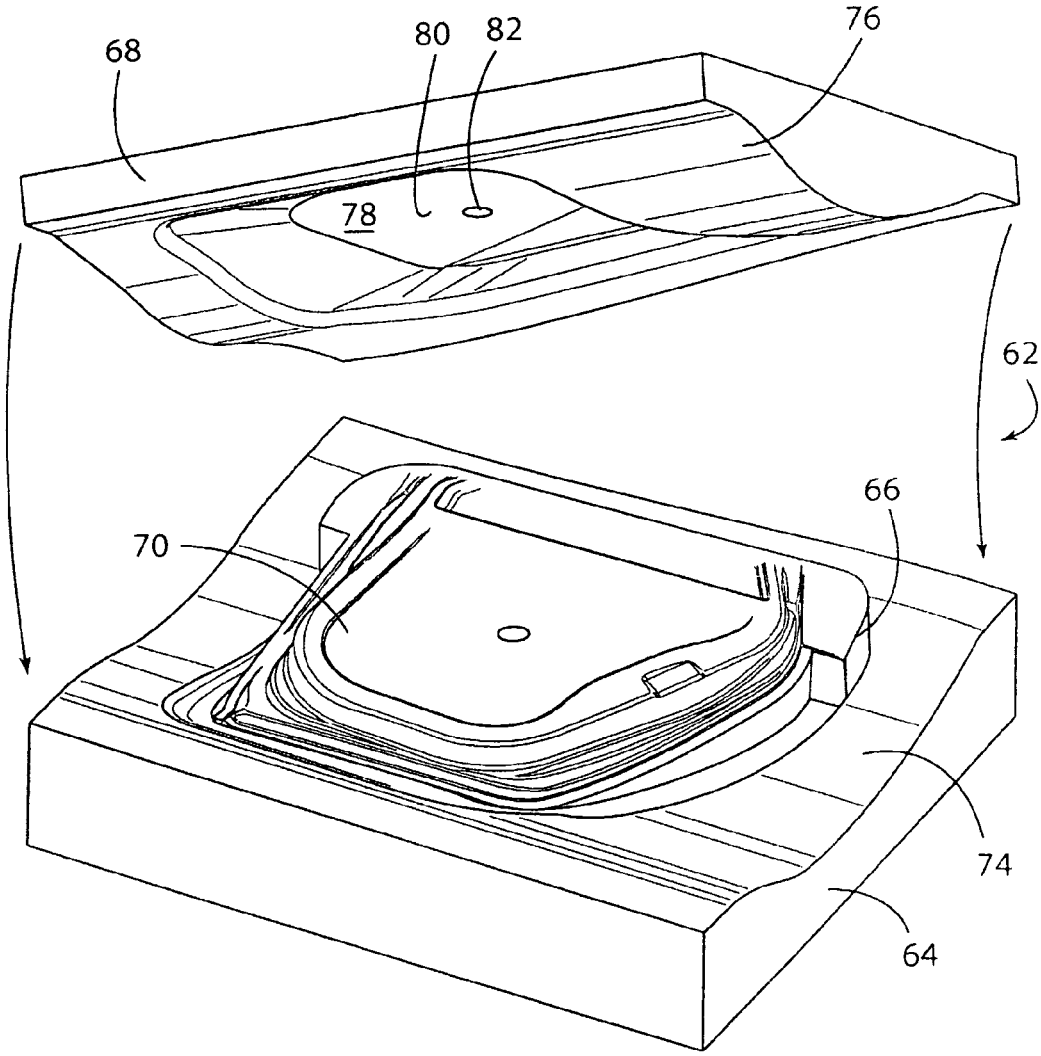
FIG. 3 is a perspective view of a forming apparatus according to the present invention used to form the inner door panel illustrated in FIG. 2.

FIG. 2 illustrates one type of a part, specifically the lower portion of an inner door panel 60, formed from a metal sheet using a forming apparatus or die set, seen generally at 62 (see FIG. 3,) according to the present invention. The present invention can be used with a variety of materials, i.e., 5000 series Aluminum-Magnesium alloys such as 5182, 5754 sheet alloy or AZ31 magnesium sheet alloy, all of which are commonly used and require no special processing. As illustrated in FIG. 3 the die set 62 includes a blank holder 64, a punch 66 and an upper die 68. The forming surface 70 of the punch is configured to shape the inner door panel 60 during the forming process. As illustrated, the cavity 78 has a non-forming surface 80 that does not contact the door panel 60 during the forming process. Accordingly, during the forming process the outer, visible class A surface 72 of the inner door panel 60 is spaced from the non-forming surface 80 of the upper die 68 of the die set 62 during the forming process. As disclosed above, closing the blank holder 64 and upper die 68, both having complementary curved or complex surfaces 74, 76, sandwiches the metal sheet between the blank holder 64 and upper die 68 to create an initial preform shape. In one embodiment of the forming process, the punch 66 travels upward and into the cavity 78 formed in the upper die 68 to draw material of the metal sheet into the cavity 78. High-pressure gas enters the cavity 78 through passageway 82 and acts on the metal sheet to press the metal sheet against the forming surface 70 of the punch 66 to complete the forming process.

Figures 4, 5, 6, 10, 11:
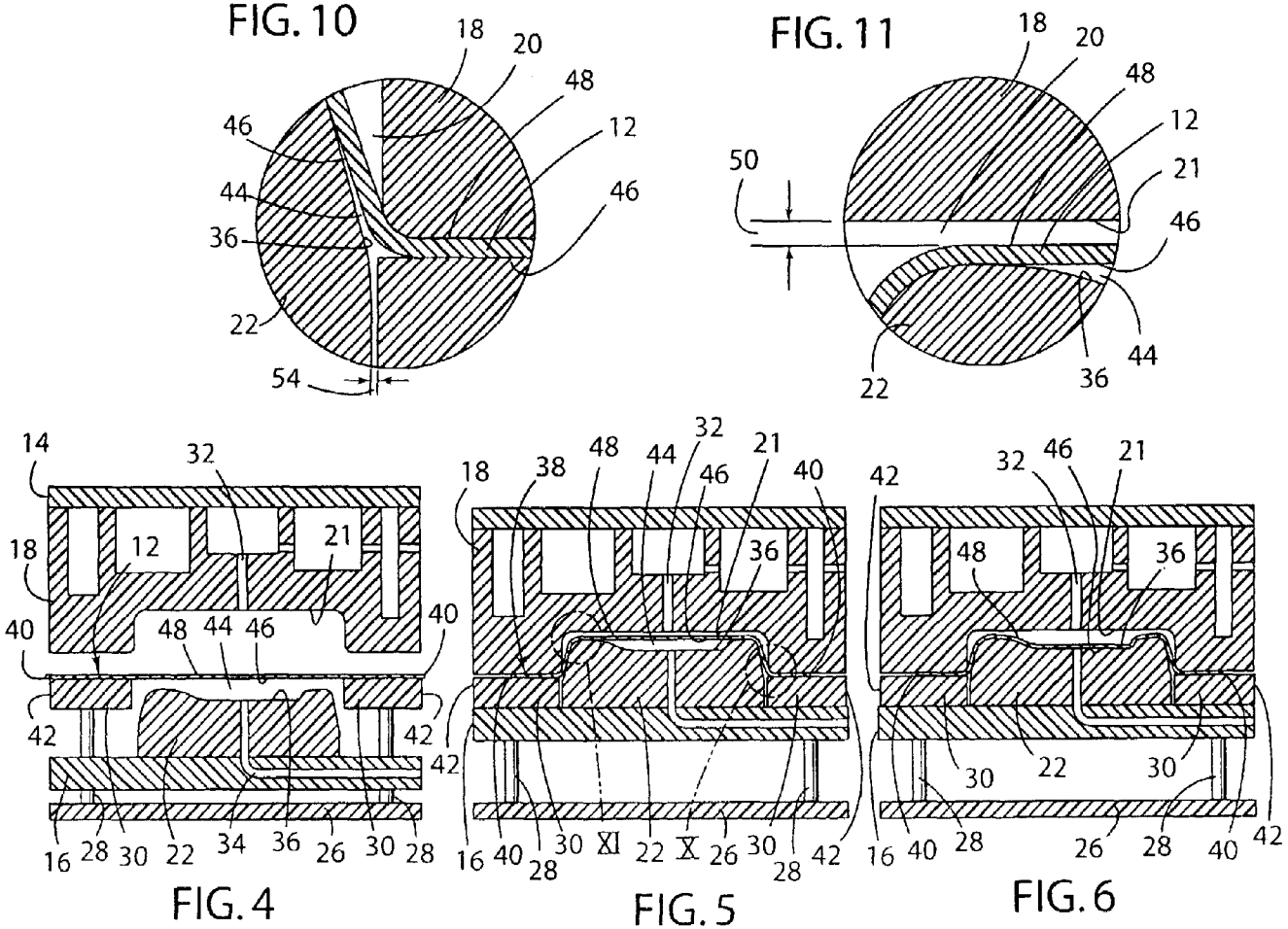
FIGS. 4-9 are cross-sectional views illustrated in the relative positions of the apparatus of the present invention, the workpiece, and the punch and die cavity during the forming steps utilized in the forming process of the present invention.
FIG. 10 is an enlarged view of circle 10 as shown in FIG. 5 illustrating the gap between the workpiece and the upper die.
FIG. 11 is an enlarged view of circle of 11 as shown in FIG. 5 illustrating the gap between the punch and blank holder.

FIGS. 4-9 illustrate a method of the superplastic forming a ductile material using the forming apparatus 10 of the present invention. Specifically, FIGS. 4-9 show the progression of steps in the forming process according to one embodiment of a method according to the present invention. Initially, the upper and lower die shoes 14, 16 along with the upper die 18, punch 22 and blank holder 30 are heated to a predetermined temperature, with the temperature dependent upon the composition of the material of the workpiece 12 being formed. Heating of the components of the forming apparatus 10 can be accomplished through electrical resistance directly or indirectly. The workpiece 12 is also heated to a predetermined forming temperature. As shown, the upper and lower die shoes 14, 16 are operative to move in a reciprocal manner between an open and a closed position. FIG. 4 illustrates the forming tool 10 and an open position wherein the workpiece 12 is loaded onto the blank holder 30 whereby the forming apparatus 10 is in an initial, loaded position, with the blank holder 30 supporting the workpiece 12 in a position raised above the punch 22.

Next, the upper die shoe 14 and upper die 18 are lowered until the upper die 18 engages the workpiece 12 and sandwiches the workpiece 12 between the upper die 18 and blank holder 30. Continued downward movement of the upper die 18 applies pressure on the blank holder 30 causing the blank holder 30 and workpiece 12 to travel downward until the workpiece 12 engages and wraps around the punch 22 with the blank holder 30 controlling the amount of material flow into the forming tool 10. The flow of the workpiece 12 into the die cavity 20 can be seen at reference 38, FIG. 5, wherein the ends 40 of the workpiece 12 are spaced a distance from the ends 42 of the blank holder 30. Consequently, the amount of the workpiece 12 drawn into the die cavity 20 during the preform or draw stage is directly related to the amount of force provided by the blank holder 30. The force applied by the cushion system 24 controls the degree or amount of workpiece 12 drawn into the die cavity 20 between the blank holder 30 and upper die 18. Controlling the force applied by the cushion system 24 during the draw process helps form a well-defined part free from wrinkles.

FIG. 5 illustrates the forming tool 10 in the lower/closed position wherein the punch 22 engages the workpiece 12 and draws the material of the workpiece 12 over the forming surface 36 of the punch 22. As shown, after the workpiece 12 is drawn over the forming surface 36 of the punch 22, a gap or space 44 exists between the bottom surface 46 of the workpiece 12 and the forming surface 36 of the punch 22. With the top surface 48 of the workpiece 12 being the class A surface.

FIG. 6 illustrates the next step in the process wherein gas pressure is applied to the cavity 20 in the upper die 18 through the passage 32 to complete the forming process. Initially, the pressure applied by the cushion system 24 sandwiching the workpiece 12 between the upper die 18 and blank holder 30 is suitable for the first or drawings step only. The pressure or force generated by the cushion system 24 is not sufficient to create a gas pressure seal between the workpiece 12 and the upper die 18. Instead, as illustrated in FIG. 5 when the blank holder 30 reaches its lowest position it engages and is supported by the lower die shoe or platen 16 that rests on the press bed. Accordingly, once the blank holder 30 is down or at its lowest position, the cushion system 24 is disengaged until the gas forming cycle is complete.

The gas pressure seal is created by the high tonnage or force generated from the press ram (not shown) that applies the force necessary to create a pressure seal between the top surface 48 of the workpiece 12 and the upper die 18. The sufficiency of the pressure seal being such that when high pressure gas is injected into the cavity 20 the gas pressure acts on the top surface 48 of the workpiece 12 and forces the material of the workpiece 12, specifically the bottom surface 46 thereof, to conform to the forming surface 36 of the punch 22 producing the shape of the finished part. Accordingly, the force generated by the press ram can be increased or decreased as necessary to maintain the pressure seal.

As illustrated in FIG. 11, the gap 50 between the top surface 48 of the workpiece 12 and the upper die 18 is kept at a minimum to minimize the volume of the cavity 20 and reduce the volume of gas used during the forming process. The passage 34 in the punch 22 communicates with the gap or space 44 and vents any pressure buildup between the workpiece 12 and the forming surface 36 of the punch 22 as the workpiece 12 is forced on to the forming surface 36 of the punch 22 during the forming process. The passage 34 is schematically illustrated as a single line terminating in a single opening in the forming surface 36 of the punch 22. Applicants contemplate additional embodiments wherein the passage 34 is a plurality of small vent passages terminating at multiple locations on the punch surface that allow the air between the forming surface 36 of the punch 22 and the workpiece 12 to exit as the workpiece 12 conforms to the punch 22. Using a calculation of workpiece 12 material flow during the gas pressure forming portion is one way of determining where to locate each of the multiple vent passages. In such instances, all of the small vent passages may be connected to a single passage within the punch 22/lower die shoe 16 that opens to the atmosphere. If a sufficient number of vent passages are not used, once the passage openings are covered air could no longer escape and this could prevent the workpiece 12 from forming properly.

Figure 9:
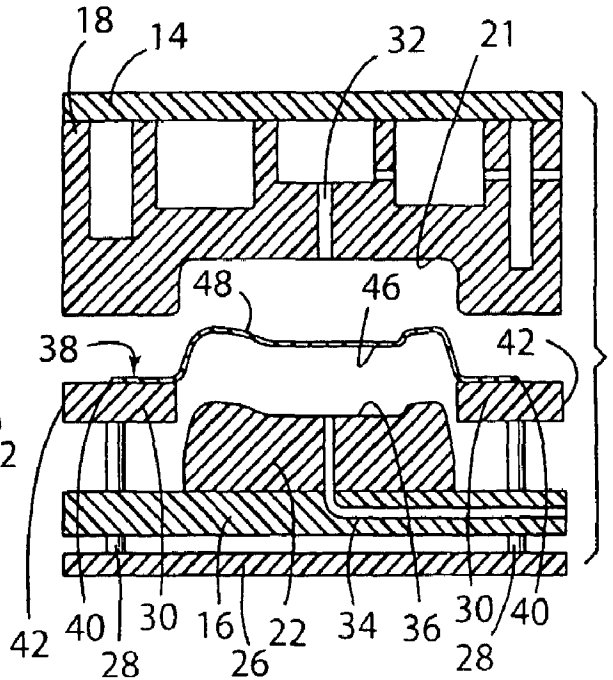
Figure 8:
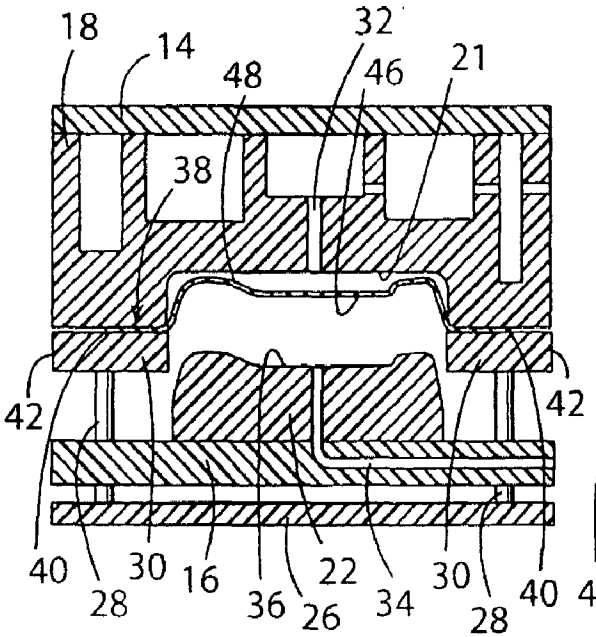
Figure 7:
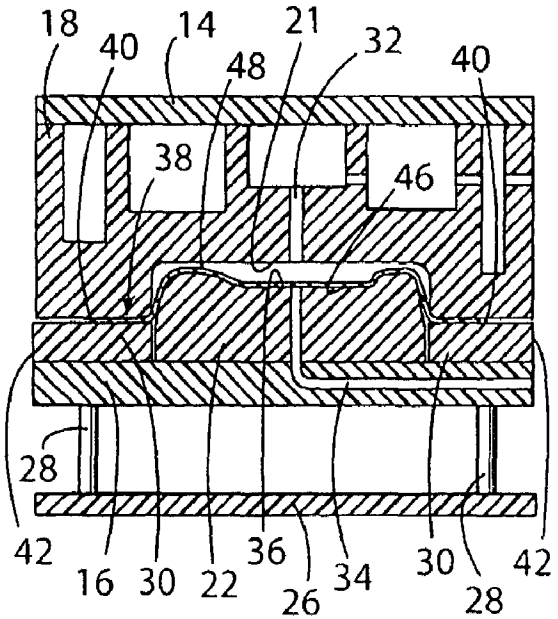

Once the gas pressure completes the forming process, as illustrated in FIG. 8, raising the upper die 18 in concert with the blank holder 30 releases or lifts the formed workpiece or part off the forming surface 36 of the punch 22. An additional aspect of the invention includes opening both the passage 32 in the upper die 18 and the passage 34 in the punch 22 to the atmosphere prior to lifting the upper die 18 and blank holder 30. Opening the respective passages 32, 34 enables air to move freely into the die cavity 20 and underneath the workpiece 12 to equalize the pressure on both sides of the workpiece 12 thereby minimizing any pressure differential between the top and bottom surfaces 48, 46 of the workpiece 12 when the forming apparatus 10 components separate. If a pressure differential exists on opposite surfaces 48, 46 of the workpiece 12 when the forming apparatus 10 components are separated, it may cause a workpiece 12 distortion. For example, a vacuum effect existing when the apparatus 10 components are separated, while brief and dissipating quickly, can result in air pressure differential between the upper die 18 and punch 22 as they separate whereby this momentary pressure differential causes the formed workpiece 12 to distort. If air can enter freely, however, through open upper die 18 passage 32 and punch 22 passage 34 the pressure on both surfaces 48, 46 of the formed workpiece 12 will be equal thus reducing the potential for part distortion upon opening of the forming apparatus 10. Upon raising the blank holder 30 to its initial or starting position, as illustrated in FIG. 9 the upper die 18 continues its upward travel, with the finished workpiece 12 left on the blank holder 30 wherein it is then removed from the forming apparatus 10.

In some instances, including those wherein the workpiece 12 is formed into a configuration not easily released from forming surface 36 of the punch 22, it may be necessary to leave the blank holder 30 in the lowered position while raising the upper die 18 such that the part workpiece remains on the blank holder 30 and punch 22. Using a suitable distribution system cooling air is applied for a period of time, typically between 5 and 45 seconds to the upper exposed surface 48 of the workpiece to cool the workpiece 12 and increase the yield strength of the workpiece 12 whereby it can be removed from the punch 22 without distortion. Accordingly, once the workpiece 12 has reached the proper cooling level or temperature level, the blank holder 30 is raised to remove the workpiece 12 from the punch 22. Further, an additional embodiment of the invention contemplates the use of extraction pins located in the punch. The extraction pins are normally located flush with the forming surface 36 during the forming process. Once the forming process is complete, the extraction pins are raised by an actuation system whereby the pins assist in lifting the formed workpiece 12 off the punch 22.

Accordingly, the blank holder 30 raises to enable easy loading of the work piece 12 in the forming apparatus 10 and acts to strip or remove the formed workpiece 12 from the forming apparatus 10, specifically the punch 22, thereby simplifying workpiece or part 12 extraction. Additionally, the forming apparatus 10 can accommodate a hot workpiece 12, wherein the workpiece 12 is heated to forming temperature prior to being placed in the forming apparatus 10 and workpiece unloading automation, wherein a mechanical apparatus removes the formed workpiece 12 from the blank holder 30.

Coating and/or texturing the forming surface 36 of the punch 22 promotes release of the formed workpiece 12 at the end of the forming process. Examples of coating include but are not limited to electroless nickel, chrome and nickel-boron nitride. Coating the forming surface, including use of a solid lubricant, promotes workpiece 12 release from the forming surface 36 of the punch 22 following the complete forming of the workpiece 12. The solid lubricant may contain multiple binders, surfactants, adherents and boron nitride solid particles. The solid lubricant is able to withstand the forming temperatures of the process, which can range from 375° C. to 525° C. Many processes such as glass bead blasting or chemical etching are suitable for texturing the forming surface 36 of the punch 22.

Figure 13:
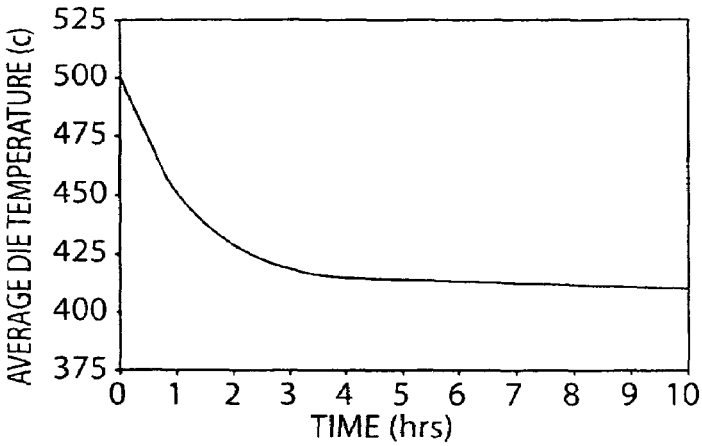
FIG. 13 is a graph of average die temperature versus time.

The present invention utilizes the forming apparatus 10 and a method of use thereof to achieve forming times faster than conventional superplastic forming. When using conventional superplastic die heating methods, such as conduction with heated platens, faster forming times can lead to production runs larger than experienced in conventional superplastic forming process, which causes a decrease in the average die temperature over a series of subsequent production runs, one example of which is seen in FIG. 13, the time and temperature change will vary based on the part, heating system, forming apparatus, etc. Although the forming apparatus 10 and process according to the present invention is robust enough to tolerate a wide range of temperatures, self-heated die shoes or platens heated with supplemental heating elements or individually heated components such as the blank holder 30 can be employed.

Figure 12:
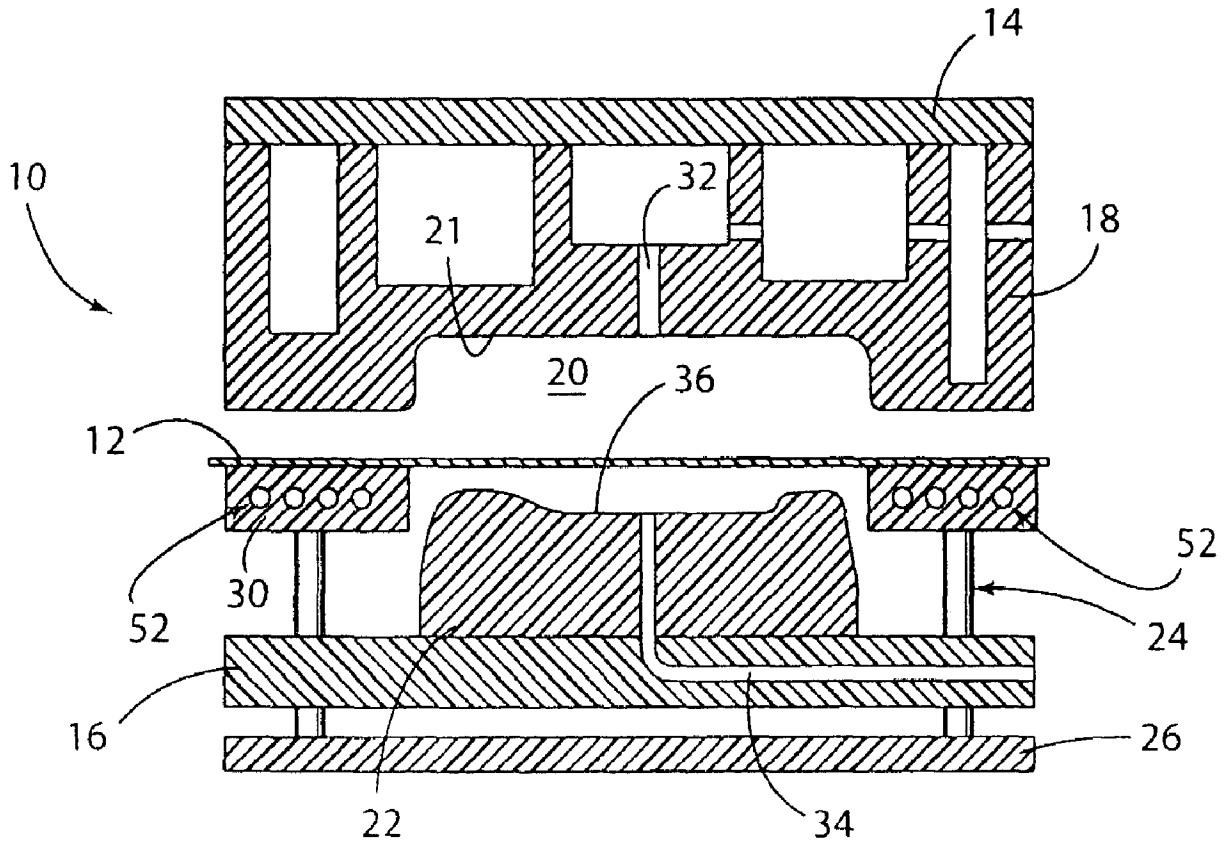
FIG. 12 illustrates an alternative embodiment of the forming apparatus of the present invention including heating elements located in the blank holder.

In one embodiment, platen heating along with supplemental heating, achieves primary heating of the upper die 18 and punch 22 through conduction with the heated press upper and lower die shoes or platens 14, 16. The blank holder 30, however, has a significant operating time raised and out of contact with the lower die shoe or platen 16, therefore, temperature loss in the blank holder 30 can be significant. FIG. 12 illustrates an additional embodiment wherein the blank holder 30 includes electric cartridge heaters 52 to improve temperature control. The heaters 52 can be zone controlled using thermocouples to monitor temperature and provide feedback to a controller to maintain a predetermined blank holder 30 temperature. In addition, to help maintain and improve temperature control, the exterior of the forming apparatus 10 can be insulated with board insulation and/or blanket insulation. An example of the board insulation is Marinite I or P-board insulation that can be machined and cut to the appropriate configuration. An example of blanket insulation is a Unifrax Insulfrax 1800 blanket.

Figure 14:
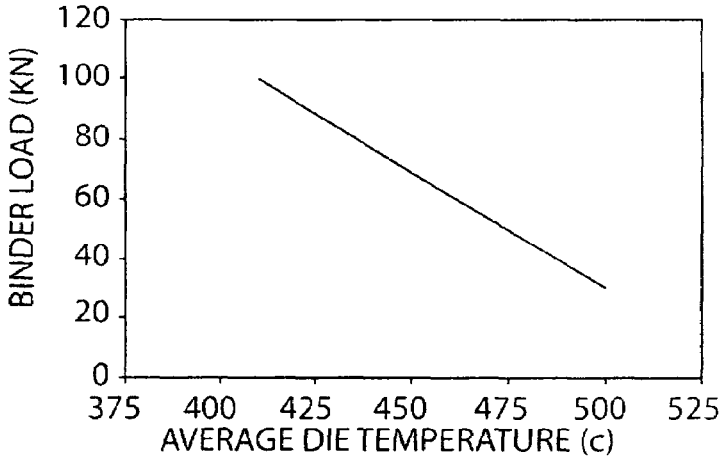
FIG. 14 is a graph of blank holder load versus average die temperature.

As indicated the forming apparatus 10 offers robust sheet formability over a wide range of temperatures. Forming can be done between 375° C. and 525° C. As explained above, during subsequent production runs the average temperature of the forming apparatus 10 can change by approximately 100° C., for example the forming apparatus 10 may start at 500° C. and end at 400° C., and still achieve an acceptable workpiece or part 12 quality with respect to thickness profile, surface finish and dimensional tolerance. While this tolerance to forming temperature and temperature gradient enables the use of platen heating and lowers the complexity and investment cost of the forming apparatus 10 by not requiring self-heated dies, the change in temperature experienced during subsequent production runs may require adjustment of the blank holder 30 pressure as the forming apparatus 10 temperature changes. The change in blank holder 30 pressure is a function of the change in workpiece 12 material flow stress with respect to forming temperature. For example, to maintain equivalent forming performance as the forming apparatus 10 temperature decreases the increase in the material's flow stress can require the blank holder 30 pressure to be increased. Accordingly, applicant invention contemplates monitoring the temperature of the forming apparatus 10 and changing the blank holder pressure to compensate for temperature changes in the forming apparatus 10, particularly as the forming apparatus 10 cools. FIG. 14 illustrates one example of the relationship between temperature and blank holder pressure or load. The relationship can be established by experimental forming trials or estimated by calculating the percentage change in flow stress over subsequent forming cycles based on a baseline forming cycle temperature and current forming cycle temperature. Applying the percent increase to the initial blank holder pressure or force establishes the new blank holder pressure or force for the new lower forming temperature. Once a relationship, as shown in FIG. 14 has been established blank holder pressure or force adjustment can be applied automatically throughout a production run by programming the press software and/or controller to monitor the forming apparatus temperature and adjust the blank holder pressure or load accordingly.

Figure 15:
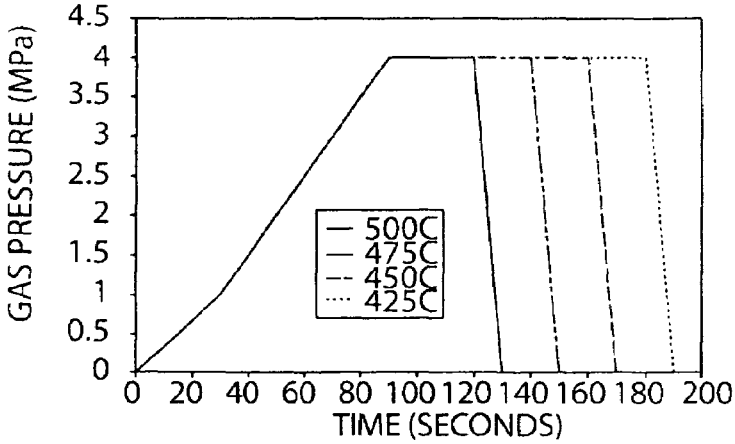
FIG. 15 is a graph of gas pressure versus time.

Gas pressure cycles used in the method of the present invention are different from conventional superplastic forming cycles that use low pressure of less than 0.5 MPa during the first 60 to 300 seconds to prevent the workpiece from rupturing during the initial bulk deformation or approximately 75% of the deformation of the workpiece or blank 12 into the die cavity. One example of the present invention contemplates that the bulk of the workpiece or blank 12 forming, approximately 75% of the forming, is done in the drawing stage of the forming process. Accordingly, the low pressure portion of the conventional superplastic forming cycle is not needed. The forming apparatus 10 according to one embodiment of the present invention is designed to form the workpiece 12 at a temperature between 375° C. and 525° C. in less than 180 seconds. As illustrated, FIG. 15 depicts one example of a gas pressure curve used to practice the present invention including a linear, stepped or non-linear increase in pressure to at least 1 MPa within at least 30 seconds of the start of the pressure cycle. A linear, stepped or non-linear ramp increase to 4 MPa or the maximum pressure of the forming apparatus 10 is then completed over at least 30 seconds. Maintaining a dwell at this maximum pressure for at least 30 seconds finishes the forming of the finer features of the configuration of the workpiece 12 and completes the forming cycle. The gas pressure is dumped from the cavity 20 no later than 180 seconds into the forming cycle. The dump should take no longer than 10 seconds. Further, the gas pressure applied to the cavity 20 is monitored and the blank holder pressure at the workpiece upper die interface can be increased as necessary to maintain the pressure seal.

The forming apparatus 10 and process is very robust in expanding the forming window of aluminum and magnesium sheet alloys. Further, the process is tolerant of the large changes in temperature that can occur during a production run and does not require the gas curve to be altered to prevent sheet rupture. It may be necessary, however, to adjust the maximum pressure dwell time as the forming apparatus 10 temperature changes to ensure the complete forming of the workpiece 12. Dwell time changes are a function of the change in flow stress with respect to temperature. For example, as illustrated in FIG. 15 as the forming apparatus 10 temperature decreases from run to run in a production process, the flow stress of the material or the workpiece 12 increases thereby requiring longer duration of maximum pressure dwells to finish the fine details of the workpiece 12. Such dwell time extension can be determined through experimental forming trials or by finite element analysis. Once a relationship between dwell time and forming apparatus temperature has been established, dwell time adjustments can be applied automatically throughout a production run by programming the press software and/or controller to monitor the forming apparatus temperature and adjust the maximum pressure dwell time accordingly.

The punch 22 acts as the guide for the blank holder 30 to ensure during the raising and lowering of the blank holder 30 that it remains located correctly in reference to the upper die 18 and punch 22. As illustrated in FIG. 10 a small gap 54 between the punch 22 and blank holder 30 enables movement between the two components. If the gap 54 is too big the blank holder 30 is not properly guided by the punch 22, if the gap 54 is too small then the blank holder 30 will bind or jam on the punch 22. The invention accounts for thermal expansion of the components, specifically the size of the gap 54 between the punch 22 and blank holder 30 to ensure that a 100° C. differential between the blank holder 30 and punch 22 does not permit contact between the two components. For example, if the punch 22 is a steel punch that is 1150 mm long at room temperature, at 500° C. the punch 22 is 1156.3 mm due to a coefficient of thermal expansion of 1.37E-5 1/C. If the steel blank holder 30 surrounding the punch is 400° C. then the gap 54 between the two components must be greater than 1.6 mm over the total length or 0.8 mm per side to prevent contact due to the thermal differential. The calculation of this result is given below where $L_{punch}$ is the punch length, $X_{CTE}^{Steel}$ is the coefficient of thermal expansion for steel in the range between 400° C. and 500° C., and T is the respective temperature of the punch 22 and blank holder or binder 30.

$$L_{punch}(1 + X_{CTE}^{Steel}T_{punch}) = L_{blankholder}(1 + X_{CTE}^{Steel}T_{blankholder}), \text{ where}$$

$$L_{blankholder} = L_{punch} + \text{Gap}$$

$$L_{punch}(1 + X_{CTE}^{Steel}T_{punch}) = (L_{punch} + \text{Gap})(1 + X_{CTE}^{Steel}T_{blankholder})$$

$$\text{Gap} = L_{punch}\left[\frac{(1 + X_{CTE}^{Steel}T_{punch})}{(1 + X_{CTE}^{Steel}T_{blankholder})} - 1\right]$$

-continued $$\text{Gap} = 1150\ \text{mm}\left[\frac{(1+1.37E-5C^{-1}\times 500C)}{(1+1.37E-5C^{-1}\times 400C)}-1\right] = 1.6\ \text{mm}$$

The foregoing generally describes a draw die apparatus of the type wherein the blank holder 30 cooperates with the upper die 18. The blank holder 30 establishes a binder area in relation to the trim line of the final part to ensure that any galling marks generated during the drawing stage are not present on the class A surface upon completion of the forming process. This approach requires the generation of additional addenda outside the trim line of the part.

This new die design allows for significantly faster forming times, improved material utilization, uniform thinning and the capability to use lower cost aluminum sheet. The advantage of this system over conventional superplastic forming is that the initial mechanical forming step draws material into the die thus producing a thicker part. Additionally, the process is faster than conventional superplastic forming since most of the initial forming is accomplished by closing the apparatus. Also, the apparatus only requires a seal on one side of the workpiece. Finally, the process allows for the use of commodity alloys rather than specially processed materials since the superplastic gas forming stage primarily completes the final details of the part and acts on thicker material. The method and apparatus is suitable for forming a workpiece having a class A finish as the class A finish is opposite from and does not contact the non-forming surface of the upper die.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method of forming a workpiece comprising the steps of:

providing a forming apparatus, the forming apparatus having an upper die member, a punch and a blank holder, the upper die member having a cavity, the punch having a forming surface and the blank holder operative to move between a first, open position and a second, closed position;

placing a workpiece between the upper die member and the blank holder when the blank holder is in the first, open position;

moving one of the upper die member and the blank holder to place the blank holder in the second, closed position thereby sandwiching the workpiece between the upper die member and the blank holder;

moving the workpiece sandwiched between the upper die member and the blank holder against the punch such that the punch engages the workpiece and draws a portion of the workpiece sandwiched between the upper die member and blank holder into the cavity in the upper die member;

supplying gas pressure to the cavity wherein the gas pressure acts against one side of the workpiece to press the workpiece against the forming surface of the punch until forming of the workpiece is completed;

withdrawing the punch; and moving the upper die and blank holder to the first, open position and removing the formed workpiece.

2. A method of forming a workpiece as set forth in claim 1 including the die cavity having a non-forming surface and the step of keeping the workpiece spaced from the non-forming surface of the die cavity during the forming operation.

3. A method of forming a workpiece as set forth in claim 1 including the step of providing at least one passageway extending to and terminating at the forming surface of the punch; and venting any pressure between a lower surface of the workpiece and the forming surface of the punch as the workpiece is pressed against the forming surface of the punch.

4. A method of forming a workpiece as set forth in claim 1 including the step of using the blank holder to remove the workpiece from the punch; and separating the upper die from the blank holder to position the upper die and blank holder in the first, open position.

5. A method of forming a workpiece as set forth in claim 1 including the step of using the blank holder to control the amount of workpiece material drawn into the cavity;

monitoring the temperature of the forming apparatus; and modifying the pressure exerted on the workpiece by the blank holder based on and as a function of the temperature of the forming apparatus.

6. A method of forming a workpiece as set forth in claim 1 including the step of monitoring the temperature of the forming apparatus; and varying the gas pressure supplied to the cavity based on and as a function of the temperature of the forming apparatus.

7. A method of forming a workpiece as set forth in claim 1 including the step of applying a lubricant to the forming surface of the punch to facilitate workpiece removal.

8. A method of forming a workpiece as set forth in claim 1 including the step of using the punch to guide the blank holder and configuring the punch and blank holder based on thermal expansion properties of the punch to reduce binding of the punch and blank holder during operation of the forming apparatus.

9. A method of forming a workpiece as set forth in claim 1 including the step of raising the upper die first to cool the workpiece prior to raising the blank holder to lift the completed part off the punch.

10. A method of forming a workpiece comprising the steps of:

providing a forming apparatus operative to move between a first, open position and a second, closed position;

providing the forming apparatus with a first die member having a cavity and a punch, the punch having a forming surface;

providing a blank holder operative to move between a first, workpiece loading position and a second, forming position;

providing a cushion system supporting the blank holder and operative to exert a force against the blank holder and the first die member;

heating the first die member and the punch to a predetermined temperature;

placing a heated workpiece on the blank holder when the blank holder is in the first, workpiece loading position;

moving one of the blank holder and first die member to place the blank holder in the second, forming position to sandwich the workpiece between the upper die member and the blank holder;

moving one of the first die member and the punch to press one side of the workpiece against the forming surface of the punch to draw a portion of the workpiece into the cavity of the first die member and begin the forming process;

continuing the forming process by maintaining contact between the punch and the workpiece and applying gas pressure to the workpiece to press a workpiece against the forming surface of the punch until forming of the workpiece is completed; and moving the forming apparatus to the second, open position to remove the formed workpiece.

11. A method of forming a workpiece as set forth in claim 10 wherein the step of continuing the forming process by maintaining contact between the punch and the workpiece includes the step of maintaining a space between the workpiece and a surface of the die cavity of the first die member such that the workpiece does not contact the non-forming surface of the die cavity during the forming process.

12. A method of forming a workpiece as set forth in claim 10 including the step of providing a forming process including a press ram;

using the press ram to maintain a pressure seal between the first die member and the workpiece and increasing press ram force as necessary to maintain the pressure seal.

13. A method of forming a workpiece as set forth in claim 10 including the step of monitoring the temperature of the forming apparatus; and varying the gas pressure applied to the workpiece based on and as a function of the temperature of the forming apparatus.

14. A method of forming a workpiece as set forth in claim 10 including the step of providing at least one passageway extending to and terminating at the forming surface of the punch; and venting any pressure between a lower surface of the workpiece and the forming surface of the punch as the workpiece is pressed against the forming surface of the punch.

15. A method of forming a workpiece as set forth in claim 10 wherein the step of moving the forming apparatus to the second, open position to remove the formed workpiece includes the step of moving the blank holder in relation to the punch to remove the workpiece from the punch; and after removing the workpiece from the punch, separating the first die member from the blank holder whereby the formed workpiece rests on the blank holder.

16. A method of forming a workpiece as set forth in claim 10 wherein the step of moving one of the blank holder and the first die member to the second, forming position includes the step of moving the first die member in a direction toward the blank holder; and continuing movement of the first die member until the first die member engages the workpiece placed on the blank holder whereby continued travel of the first die member acts against pressure exerted by the cushion system such that the pressure exerted by the cushion system controls flow of workpiece material drawn into the cavity by the punch.

17. A method of forming a workpiece as set forth in claim 16 wherein the pressure exerted by the cushion system varies dependent upon forming apparatus temperature.

18. An apparatus for forming a workpiece comprising:

an upper die shoe and a lower die shoe, said upper die shoe and said lower die shoe operative to move between a first open position and a second closed position;

a die member having a cavity connected to one of said upper die shoe and said lower die shoe, said cavity having a non-forming surface;

a punch, connected to one of said upper die shoe and said lower die shoe and positioned opposite said die member, said punch having a forming surface, said forming surface configured to form the workpiece in a final workpiece shape wherein when said upper and lower die shoes are placed in said second closed position, said punch extends into said cavity and remains spaced from said non-forming surface of said die cavity;

a blank holder supported by a cushion system;

a gas pressure source force applying gas to said cavity; and at least one passageway extending to and terminating at the forming surface of the punch.

19. An apparatus for forming a workpiece as set forth in claim 18 wherein said apparatus provides a gas pressure seal only between the upper surface of the workpiece and upper die member wherein gas pressure in the cavity forms the workpiece on the forming surface of the punch.

* * * * *